United States Patent [19]

Hasegawa

[11] Patent Number: 4,938,267

[45] Date of Patent: Jul. 3, 1990

[54] GLASSY METAL ALLOYS WITH PERMINVAR CHARACTERISTICS

[75] Inventor: Ryusuke Hasegawa, Morristown, N.J.

[73] Assignee: Allied-Signal Inc., Morris Township, Morris County, N.J.

[21] Appl. No.: 233,979

[22] Filed: Aug. 18, 1988

Related U.S. Application Data

[63] Continuation of Ser. No. 817,193, Jan. 8, 1986, abandoned.

[51] Int. Cl.[5] ..... H01F 1/04

[52] U.S. Cl. ..... 148/304; 148/403; 420/435; 420/436; 420/437; 420/438; 420/439; 420/440

[58] Field of Search ..... 148/403, 304; 420/435, 420/440

[56] References Cited

U.S. PATENT DOCUMENTS

| | | | |
|---|---|---|---|
| 4,038,073 | 7/1977 | O'Handley et al. | 148/403 |
| 4,188,211 | 2/1980 | Yamaguchi et al. | 148/403 |
| 4,225,339 | 9/1980 | Inomata et al. | 75/122 |
| 4,288,260 | 9/1981 | Senno et al. | 148/121 |
| 4,411,716 | 10/1983 | Shiiki et al. | 148/403 |
| 4,420,348 | 12/1983 | Shiiki et al. | 148/403 |
| 4,424,459 | 1/1984 | Inomata et al. | 307/415 |
| 4,439,253 | 3/1984 | Ramanan | 148/403 |
| 4,473,417 | 9/1984 | Inomata et al. | 148/403 |
| 4,525,222 | 6/1985 | Meguro et al. | 148/121 |

FOREIGN PATENT DOCUMENTS

| | | | |
|---|---|---|---|
| 0084138 | 7/1983 | European Pat. Off. | 148/31.55 |
| 59-41807 | 3/1984 | Japan | 420/435 |

OTHER PUBLICATIONS

Applied Physics Letters, vol. 36, No. 4, Feb. 1980. Koichi Aso "Observation of Magnetic Hysteresis Loop of the Perminvar Type in Worked Co-Based Amorphous Alloys" pp. 339-341.

*Primary Examiner*—John P. Sheehan
*Attorney, Agent, or Firm*—Gus T. Hampilos

[57] ABSTRACT

A series of glassy metal alloys with near zero magnetostriction and Perminvar characteristics of relatively constant permeability at low magnetic field excitations and constricted hysteresis loops is disclosed. The glassy alloys have the compositions $Co_aFe_bNi_cM_dB_eSi_f$ where M is at least one member selected from the group consisting of Cr, Mo, Mn and Nb, and "a-f" are in atom percent where "a" ranges from about 66 to 71, "b" ranges from about 2.5 to 4.5, "c" ranges from about 0 to 3, "d" ranges from about 0 to 2 except when M=Mn in which case "d" ranges from about 0 to 4, "e" ranges from about 6 to 24 and "f" ranges from about 0 to 19, with the proviso that the sum of "a", "b" and "c" ranges from about 72 to 76 and the sum of "e" and "f" ranges from about 25 to 27. The glassy alloy has a value of magnetostriction ranging from about $-1\times10^{-6}$ to about $+1\times10^{-6}$, a saturation induction ranging from about 0.5 to 1 Tesla, a Curie temperature ranging from about 200 to 450° C. and a first crystallization temperature ranging from about 440 to 570° C. The glassy alloy is heat-treated between about 50 and 110° C. below its first crystallization temperature for a time period ranging from about 15 to 180 minutes, then cooled to room temperature at a rate slower than about −60° C./min.

21 Claims, 1 Drawing Sheet

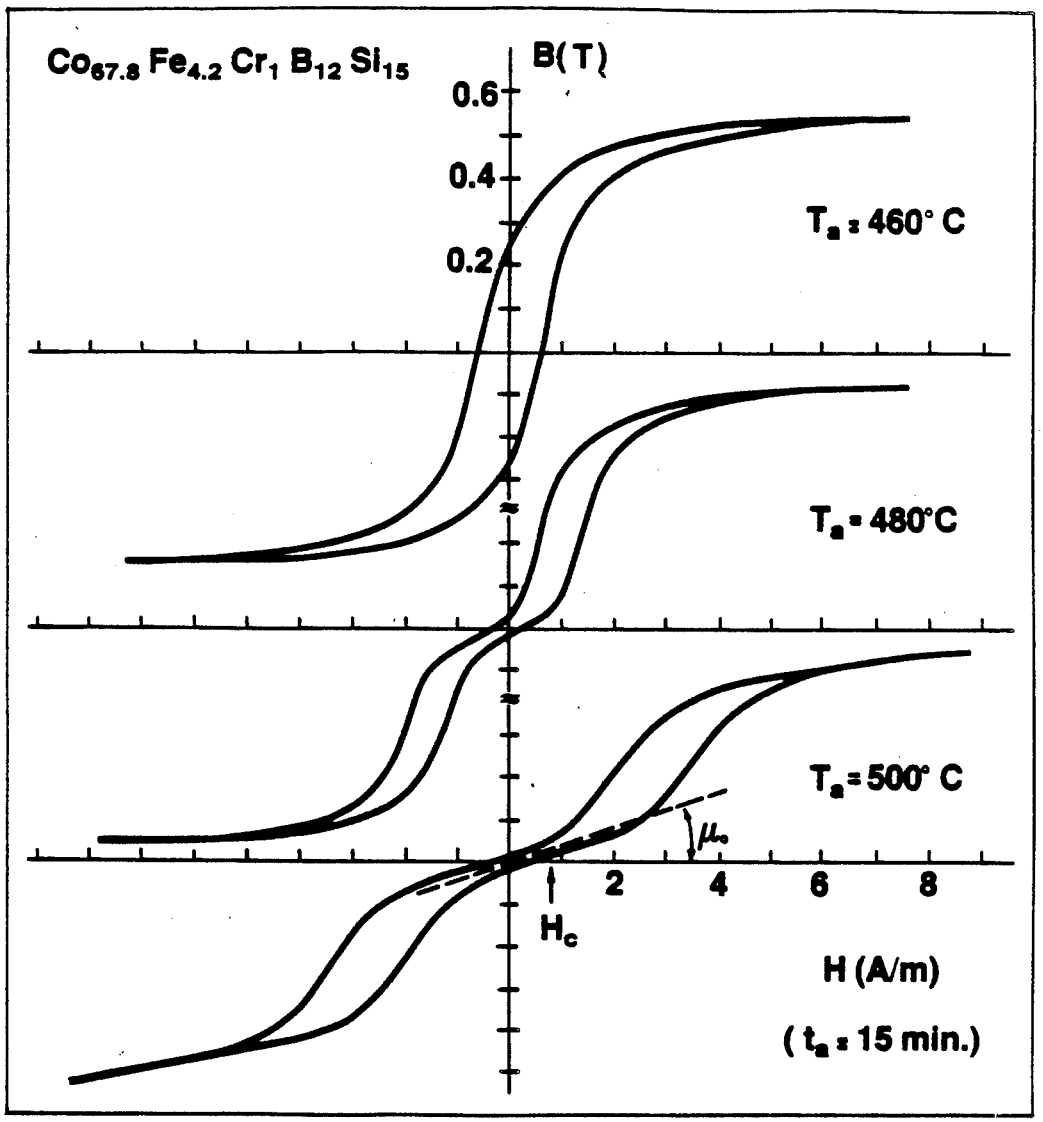
$Co_{67.8}Fe_{4.2}Cr_1B_{12}Si_{15}$
B(T)
0.6
0.4
0.2
$T_a$ = 460° C
$T_a$ = 480°C
$T_a$ = 500° C
$\mu_o$
2
4
6
8
$H_c$
H (A/m)
( $t_a$ = 15 min.)

GLASSY METAL ALLOYS WITH PERMINVAR CHARACTERISTICS

This application is a continuation of application Ser. No. 817,193 filed Jan. 8, 1986, now abandoned.

BACKGROUND OF INVENTION

1. Field of Invention

This invention relates to glassy metal alloys with Perminvar characteristics that is constant permeabilities at low magnetic field excitations and constricted hysteresis loops. More particularly, this invention provides glassy metal alloys with highly non-linear magnetic properties at low magnetic excitation levels.

2. Description of Prior Art

The magnetic response, namely magnetic induction caused by magnetic excitation, of a typical ferromagnet, is non-linear characterized by a hysteresis loop. This loop usually does not allow a relatively constant permeability near the zero-excitation point. To realize such a feature, so-called Perminvar alloys were developed [see, for example, R. M. Bozorth, *Ferromagnetism* (Van Nostrand, Co., Inc. N.Y., 1951) p. 166–180]. These alloys are usually based on crystalline iron-cobalt-nickel system. Typical compositions (weight percent) include 20%Fe-60%Co-20%Ni (20-60 Perminvar) and 30%Fe-25%Co-45%Ni (45-45 Perminvar). Improvements of the crystalline Perminvar alloys have been made. Of significance is the addition of molybdenum, as exemplified by the synthesis of 7.5-45-25 Mo-Perminvar (7.5%Mo-45%Ni-25%Co-22.5%Fe). This material, when furnace cooled from 1110° C., exhibited a dc coercivity ($H_c$) of 40 A/m (=0.5 Oe), initial permeability ($\mu_o$) of 100 and the remanence ($B_r$) of 0.75 T.

In the advent of modern electronics technology, it becomes necessary to further improve the Perminvar-like properties. For example, further reduction $H_c$ and increase of $\mu o$ would be desirable when an efficient transformer requiring low field modulations is needed. Furthermore, the usual non-linear characteristic of the conventional Perminvar alloys cannot be utilized without a large level of excitation of well above 80 A/m (=1 Oe). Also desirable in many applications are low ac magnetic losses. One approach to attain these excellent soft magnetic properties is to reduce the materials'magnetostriction values as low as possible.

Saturation magnetostriction $\lambda_s$ is related to the fractional change in length $\Delta l/l$ that occurs in a magnetic material on going from the demagnetized to the saturated, ferromagnetic state. The value of magnetostriction, a dimensionless quantity, given in units of microstrains (i.e., a microstrain is a fractional change in length of one part per million).

Ferromagnetic alloys of low magnetostriction are desirable for several interrelated reasons:

1. Soft magnetic properties (low coercivity, high permeability) are generally obtained when both the saturation magnetostriction $\lambda_s$ and the magnetocrystalline anisotropy K approach zero. Therefore, given the same anisotropy, alloys of lower magnetostriction will show lower dc coercivities and higher permeabilities. Such alloys are suitable for various soft magnetic applications.

2. Magnetic properties of such zero magnetostrictive materials are insensitive to mechanical strains. When this is the case, there is little need for stress-relief annealing after winding, punching or other physical handling needed to form a device from such material. In contrast, magnetic properties of stress-sensitive materials, such as the crystalline alloys, are seriously degraded by such cold working and such materials must be carefully annealed.

3. The low dc coercivity of zero magnetostrictive materials carries over to ac operating conditions where again low coercivity and high permeability are realized (provided the magnetocrystalline an isotropy is not too large and the resistivity not too small). Also because energy is not lost to mechanical vibrations when the saturation magnetostriction is zero, the core loss of zero magnetostrictive materials can be quite low. Thus, zero magnetostrictive magnetic alloys (of moderate or low magnetocrystalline anisotropy) are useful where low loss and high ac permeability are required. Such applications include a variety of tape-wound and laminated core devices, such as power transformers, signal transformers, magnetic recording heads and the like.

4. Finally, electromagnetic devices containing zero magnetostrictive materials generate no acoustic noise under AC excitation. While this is the reason for the lower core loss mentioned above, it is also a desirable characteristic in itself because it eliminates the hum inherent in many electromagnetic devices.

There are three well-known crystalline alloys of zero magnetostriction (in atom percent, unless otherwise indicated):

(1) Nickel-iron alloys containing approximately 80% nickel ("80 nickel permalloys");

(2) Cobalt-iron alloys containing approximately 90% cobalt; and (3) Iron-silicon alloys containing approximately 6 wt. % silicon.

Also included in these categories are zero magnetostrictive alloys based on the binaries but with small additions of other elements such as molybdenum, copper or aluminum to provide specific property changes. These include, for example, 4% Mo, 79% Ni, 17% Fe (sold under the designation Moly Permalloy) for increased resistivity and permeability; permalloy plus varying amounts of copper (sold under the designation Mumetal) for magnetic softness and improved ductility; and 85 wt. % Fe, 9 wt. % Si, 6 wt. % Al (sold under the designation Sendust) for zero anisotropy.

The alloys included in category (1) are the most widely used of the three classes listed above because they combine zero magnetostriction with low anisotropy and are, therefore, extremely soft magnetically; that is they have a low coercivity, a high permeability and a low core loss. These permalloys are also relatively soft mechanically and their excellent magnetic properties, achieved by high temperature (above 1000° C.) anneal, tend to be degraded by relatively mild mechanical shock.

Category (2) alloys such as those based on $Co_{90}Fe_{10}$ have a much higher saturation induction ($B_s$ about 1.9 Tesla) than the permalloys. However, they also have a strong negative magnetocrystalline anisotropy, which prevents them from being good soft magnetic materials. For example, the initial permeability of $Co_{90}Fe_{10}$ is only about 100 to 200.

Category (3) alloys such as Fe-6 wt% Si and the related ternary alloy Sendust (mentioned above) also show higher saturation inductions ($B_s$ about 1.8 Tesla and 1.1 Tesla, respectively) than the permalloys. However these alloys are extremely brittle and have, therefore, found limited use in powder form only. Recently both Fe-6.5 wt.% Si [IEEE Trans. MAG-16, 728

(1980)]and Sendust alloys [IEEE Trans. MAG-15, 1149 (1970)]have been made relatively ductile by rapid solidification. However, compositional dependence of the magnetostriction is very strong in these materials, making difficult precise tayloring of the alloy composition to achieve near-zero magnetostriction.

It is known that magnetocrystalline anisotropy is effectively eliminated in the glassy state. It is therefore, desirable to seek glassy metal alloys of zero magnetostriction. Such alloys might be found near the compositions listed above. Because of the presence of metalloids which tend to reduce the magnetization by dilution and electronic hybridization, however, glassy metal alloys based on the 80 nickel permalloys are either non-magnetic at room temperature or have unacceptably low saturation inductions. For example, the glassy alloy $Fe_{40}Ni_{40}P_{14}B_6$ (the subscripts are in atom percent) has a saturation induction of about 0.8 Tesla, while the glassy alloy $Ni_{49}Fe_{29}P_{14}B_6Si_2$ has a saturation induction of about 0.46 Tesla and the glassy alloy $Ni_{80}P_{20}$ is non-magnetic. No glassy metal alloys having a saturation magnetostriction approximately equal to zero have yet been found near the iron-rich Sendust composition. A number of near-zero magnetostrictive glassy metal alloys based on the Co-Fe crystalline alloy mentioned above in (2) have been reported in the literature. These are, for example, $Co_{72}Fe_3P_{16}B_6A_{13}$ (AIP Conference Proceedings, No. 24, pp. 745–746 (1975)) $Co_{70.5}Fe_{4.5}Si_{15}B_{10}$ Vol. 14, *Japanese Journal of Applied Physics*, pp. 1077–1078 (1975)) $Co_{31.2}Fe_{7.8}Ni_{39.0}B_{14}Si_8$ [proceedings of 3rd International Conference on Rapidly Quenched Metals, p. 183, (1979)] and $Co_{74}Fe_6B_{20}$ [IEEE Trans. MAG-12, 942 (1976)]. However, none of the above mentioned near-zero magnetostrictive materials show Perminvar-like characteristics. By polishing the surface of a low magnetostrictive glassy ribbon, a surface uniaxial anisotropy was introduced along the polishing direction which resulted in observation of Perminvar-like Kerr hysteresis loops (*Applied Physics Letters*, vol. 36, pp. 339–341 (1980). This is only a surface effect and is not of a bulk property of the material, limiting the use of such effect in some selected devices.

Furthermore, to realize the Perminvar properties, the crystalline materials mentioned-above have to be baked for a long time at a given temperature. Typically the heat-treatment is performed at 425° C. for 24 hours. Obviously it is desirable to heat-treat the materials at a temperature as low as possible and for a duration as short as possible.

Clearly desirable are new magnetic materials with various Perminvar characteristics which are suited for modern electronics technology.

SUMMARY OF INVENTION

In accordance with the invention, there is provided a magnetic alloy that is at least 70% glassy and which has a low magnetostriction and Perminvar characteristics of relatively constant permeability at low magnetic field excitations and a constricted hysteresis loop in addition to excellent soft magnetic properties. The glassy metal alloy has the composition $Co_aFe_bNi_cM_dB_eSi_f$ where M is at least one number selected from the group consisting of Cr, Mo, Mn and Nb, "a-f" are in atom percent and the sum of "a-f" equals 100, "a" ranges from about 66 to 71, "b" ranges from about 2.5 to 4.5, "c" ranges from about 0 to 3, "d" ranges from about 0 to 2 except when M=Mn in which case "d" ranges from about 0 to 4, "e" ranges from about 6 to 24 and "f" ranges from about 0 to 19, with the proviso that the sum of "a", "b", and "c" ranges from about 72 to 76 and the sum of "e" and "f" ranges from about 25 to 27. The glassy alloy has a value of magnetostriction ranging from about $-1\times10^{-6}$ to $+1\times10^{-6}$, a saturation induction ranging from about 0.5 to 1 Tesla, a Curie temperature ranging from about 200 to 450° C. and a first crystallization temperature ranging from about 440 to 570° C. The glassy alloy is heat-treated by heating it to a temperature between about 50 and 110° C. below its first crystallization temperature for a time period ranging from 15 to 180 min., and then cooling the alloy at a rate slower than about −60° C./min.

BRIEF DESCRIPTION OF THE DRAWING

The invention will be more fully understood and further advantages will become apparent when reference is made to the following detailed description of the invention and the accompanying drawing, which is a graph depicting the B-H characteristics of an alloy of the present invention, the alloy having been annealed for fifteen minutes at the temperatures (A) 460° C., (B) 480° C. and (C) 500° C.

DETAILED DESCRIPTION OF THE INVENTION

The glassy alloy is heat-treated at a temperature $T_a$ for a duration of time $t_a$, where $\Delta T_{c\text{-}a}=(T_{cl}\text{-}T_a)$ is between 50 and about 110° C.; and $t_a$ is between about 15 and 120 minutes, followed by cooling of the material at a rate slower than about −60° C./min The choice of $T_a$ and $t_a$ should exclude the case that $\Delta T_{c-a}\sim50°$ C. and $t_a \gtrsim 15$ minutes because such combination sometimes results in crystallization of the glassy alloy.

The purity of the above composition is that found in normal commercial practice. However, it would be appreciated that the metal M in the alloys of the invention may be replaced by at least one other element such as vanadium, tungsten, tantalum, titanium, zirconium and hafnium, and up to about 4 atom percent of Si may be replaced by carbon, aluminum or germanium without significantly degrading the desirable magnetic properties of these alloys.

Examples of near-zero magnetostrictive glassy metal alloys of the invention include $Co_{70.5}Fe_{4.5}B_{15}Si_{10}$, $Co_{69.0}Fe_{4.1}Ni_{1.4}Mo_{1.5}B_{12}Si_{12}$, $Co_{65.7}Fe_{4.4}Ni_{2.9}Mo_2B_{1.1}Si_{14}$, $Co_{69.2}Fe_{3.8}Mo_2B_8Si_{17}$, $Co_{67.5}Fe_{4.5}Ni_{3.0}B_8Si_{17}$, $Co_{70.9}Fe_{4.1}B_8Si_{17}$, $Co_{69.9}Fe_{4.1}Mn_{1.0}B_8Si_{17}$, $Co_{69.0}Fe_{4.0}Mn_2B_8Si_{17}$, $Co_{68.0}Fe_{4.0}Mn_3B_8Si_{17}$, $Co_{67.1}Fe_{3.9}Mn_4B_8Si_{17}$, $Co_{68.0}Fe_{4.0}Mn_2Cr_1B_8Si_{17}$, $Co_{69.0}Fe_{4.0}Cr_2B_8Si_{17}$, $Co_{69.0}Fe_{4.0}Nb_2B_8Si_{17}$, $Co_{68.2}Fe_{3.8}Mn_1B_{12}Si_{15}$, $Co_{67.7}Fe_{3.3}Mn_2B_{12}Si_{15}$, $Co_{67.8}Fe_{4.2}Mo_1B_{12}Si_{15}$, $Co_{67.8}Fe_{4.2}Cr_1B_{12}Si_{15}$, $Co_{67.0}Fe_{4.0}Cr_2B_{12}Si_{15}$, $Co_{66.1}Fe_{3.9}Cr_3B_{12}Si_{15}$, $Co_{68.5}Fe_{2.5}Mn_4B_{10}Si_{15}$, $Co_{65.7}Fe_{4.4}Ni_{2.9}Mo_2B_{23}C_2$ and $Co_{68.6}Fe_{4.4}Mo_2Ge_4B_{21}$. These alloys possess saturation induction ($B_s$) between 0.5 and 1 Tesla, Curie temperature between 200 and 450° C. and excellent ductility. Some magnetic and thermal properties of these and some of other near-zero magnetostrictive alloys of the present invention are listed in Table I.

TABLE I

Saturation induction ($B_s$), Curie temperature ($\theta_f$), saturation magnetostriction ($\lambda_s$) and the first crystallization temperature ($T_{cl}$) of near-zero magnetostrictive alloys of the present invention.

| Compositions |
|---|

TABLE I-continued

Saturation induction ($B_s$), Curie temperature ($\theta_f$), saturation magnetostriction ($\lambda_s$) and the first crystallization temperature ($T_{cl}$) of near-zero magnetostrictive alloys of the present invention.

| Co | Fe | Ni | M | B | Si | $B_s$(Tesla) | $\theta$ f(°C.) | $\lambda$ s($10^{-6}$) | $T_{cl}$(°C.) |
|---|---|---|---|---|---|---|---|---|---|
| 70.5 | 4.5 | — | — | 15 | 10 | 0.82 | 422 | −0.3 | 517 |
| 69.0 | 4.1 | 1.4 | Mo = 1.5 | 12 | 12 | 0.73 | 324 | 0 | 520 |
| 65.7 | 4.4 | 2.9 | Mo = 2 | 11 | 14 | 0.77 | 246 | 0 | 530 |
| 68.2 | 3.8 | — | Mn = 1 | 12 | 15 | 0.70 | 266 | +0.4 | 558 |
| 67.7 | 3.3 | — | Mn = 2 | 12 | 15 | 0.71 | 246 | +0.4 | 560 |
| 67.8 | 4.2 | — | Mo = 1 | 12 | 15 | 0.62 | 227 | +0.4 | 556 |
| 67.8 | 4.2 | — | Cr = 1 | 12 | 15 | 0.64 | 234 | +0.6 | 561 |
| 69.2 | 3.8 | — | Mo = 2 | 8 | 17 | 0.67 | 295 | +0.5 | 515 |
| 67.5 | 4.5 | 3.0 | — | 8 | 17 | 0.73 | 329 | +0.5 | 491 |
| 70.9 | 4.1 | — | — | 8 | 17 | 0.77 | 343 | −0.4 | 490 |
| 69.9 | 4.1 | — | Mn = 1 | 8 | 17 | 0.77 | 331 | −0.5 | 493 |
| 69.0 | 4.0 | — | Mn = 2 | 8 | 17 | 0.75 | 312 | +0.8 | 502 |
| 68.0 | 4.0 | — | Mn = 3 | 8 | 17 | 0.74 | 271 | +0.9 | 507 |
| 67.1 | 3.9 | — | Mn = 4 | 8 | 17 | 0.74 | 269 | −0.8 | 512 |
| 69.0 | 4.0 | — | Cr = 2 | 8 | 17 | 0.63 | 261 | +0.2 | 503 |
| 68.0 | 4.0 | — | Mn = 2, Cr = 1 | 8 | 17 | 0.69 | 231 | +0.7 | 511 |
| 69.0 | 4.0 | — | Nb = 2 | 8 | 17 | 0.62 | 256 | +0.4 | 541 |
| 65.7 | 4.4 | 2.9 | Mo = 2 | 23 | C = 3* | 0.76 | 393 | 0 | 500 |
| 65.7 | 4.4 | 2.9 | Mo = 2 | 23 | 2 | 0.79 | 402 | 0 | 512 |
| 69.5 | 4.1 | 1.4 | — | 6 | 19 | 0.73 | 316 | −0.1 | 443 |
| 68.6 | 4.4 | — | Mo = 2 | 21 | Ge = 4* | 0.77 | 365 | 0 | 570 |
| 70.5 | 4.5 | — | — | 24 | Ge = 1* | 0.99 | 451 | −0.4 | 494 |
| 67.0 | 4.0 | — | Cr = 2 | 12 | 15 | 0.57 | 197 | +0.4 | 480 |
| 69.2 | 3.8 | — | Mo = 2 | 10 | 15 | 0.72 | 245 | +0.4 | 541 |
| 68.1 | 4.0 | 1.4 | Mo = 1.5 | 8 | 17 | 0.67 | 276 | +0.4 | 512 |
| 69.0 | 3.0 | — | Mn = 3 | 10 | 15 | 0.79 | 305 | +1.1 | 544 |
| 68.5 | 2.5 | — | Mn = 4 | 10 | 15 | 0.78 | 273 | +0.4 | 548 |
| 68.8 | 4.2 | — | Cr = 2 | 10 | 15 | 0.69 | 261 | +0.4 | 540 |

*All Si content is replaced by the indicated element and amount.

FIG. 1 illustrates the B(induction)-H(applied field) hysteresis loops for a near-zero magnetostrictive $Co_{67.8}Fe_{4.2}Cr_1B_{12}Si_{15}$ glassy alloy heat-treated at $T_1$=460° C. (A), $T_1$=480° C. (B) and $T_a$=500° C. (C) for 15 minutes, followed by cooling at a rate of about −5° C./min. The constricted B-H loops of FIGS. 1B and 1C are characteristic of the materials with Perminvar-like properties, whereas the B-H loop of FIG. 1A corresponds to that of a typical soft ferromagnet. As evidenced in FIG. 1, the choice of the heat-treatment temperature $T_a$ is very important in obtaining the Perminvar characteristics in the glassy alloys of the present invention. Table II summarizes the heat-treatment conditions for some of these alloys and some of the resultant magnetic properties.

| Compositions | | | | | | | | | |
|---|---|---|---|---|---|---|---|---|---|
| Co | Fe | Ni | M | B | Si | $T_a$(°C.) | $t_a$(min.) | $\Delta T_{c-a}$(°C.) | $H_c$(A/m) | $\mu_o$ |
| 70.5 | 4.5 | — | — | 15 | 10 | 460 | 15 | 57 | 3.4 | 7,900 |
| 70.5 | 4.5 | — | — | 15 | 10 | 460 | 15** | 57 | 3.1 | 5,700 |
| 70.5 | 4.5 | — | — | 15 | 10 | 460 | 15*** | 57 | 1. | 7,600 |
| 69.0 | 4.1 | 1.4 | Mo = 1.5 | 12 | 12 | 430 | 120 | 90 | 1.2 | 4,000 |
| 69.0 | 4.1 | 1.4 | Mo = 1.5 | 12 | 12 | 430 | 150 | 90 | 3.6 | 4,000 |
| 69.0 | 4.1 | 1.4 | Mo = 1.5 | 12 | 12 | 420 | 180 | 100 | 6.4 | 12,250 |
| 65.7 | 4.4 | 2.9 | Mo = 2 | 11 | 14 | 420 | 15 | 110 | 4.0 | 33,000 |
| 68.2 | 3.8 | — | Mn = 1 | 12 | 15 | 480 | 15 | 78 | 0.20 | 19,000 |
| 68.2 | 3.8 | — | Mn = 1 | 12 | 15 | 500 | 15 | 58 | 7.6 | 13,000 |
| 67.7 | 3.3 | — | Mn = 2 | 12 | 15 | 480 | 15 | 80 | 0.20 | 22,000 |
| 67.7 | 3.3 | — | Mn = 2 | 12 | 15 | 500 | 15 | 60 | 0.20 | 22,000 |
| 67.8 | 4.2 | — | Mo = 1 | 12 | 15 | 500 | 15 | 56 | 0.44 | 90,000 |
| 67.8 | 4.2 | — | Cr = 1 | 12 | 15 | 480 | 15 | 81 | 0.20 | 50,000 |
| 67.8 | 4.2 | — | Cr = 1 | 12 | 15 | 500 | 15 | 61 | 0.44 | 30,000 |
| 69.2 | 3.8 | — | Mo = 2 | 8 | 17 | 460 | 15 | 55 | 4.2 | 9,700 |
| 69.2 | 3.8 | — | Mo = 2 | 8 | 17 | 460 | 30 | 55 | 4.9 | 10,000 |
| 69.2 | 3.8 | — | Mo = 2 | 8 | 17 | 460 | 45 | 55 | 4.5 | 8,000 |
| 69.2 | 3.8 | — | Mo = 2 | 8 | 17 | 460 | 90 | 55 | 5.0 | 7,500 |
| 69.2 | 3.8 | — | Mo = 2 | 8 | 17 | 460 | 105 | 55 | 3.9 | 7,900 |
| 69.2 | 3.8 | — | Mo = 2 | 8 | 17 | 380 | 45 | 111 | 4.7 | 12,700 |
| 67.5 | 4.5 | 3.0 | — | 8 | 17 | 380 | 60 | 111 | 4.5 | 9,600 |
| 67.5 | 4.5 | 3.0 | — | 8 | 17 | 380 | 90 | 111 | 3.6 | 11,500 |
| 67.5 | 4.5 | 3.0 | — | 8 | 17 | 380 | 105 | 111 | 5.0 | 15,800 |
| 67.5 | 4.5 | 3.0 | — | 8 | 17 | 420 | 15 | 71 | 3.6 | 7,200 |
| 70.9 | 4.1 | — | — | 8 | 17 | 400 | 15 | 90 | 7.0 | 5,000 |
| 70.9 | 4.1 | — | — | 8 | 17 | | | | | |
| 69.9 | 4.1 | — | Mn = 1 | 8 | 17 | | | | | |
| 69.9 | 4.1 | — | Mn = 1 | 8 | 17 | | | | | |
| 69.0 | 4.0 | — | Mn = 2 | 8 | 17 | | | | | |
| 69.0 | 4.0 | — | Mn = 2 | 8 | 17 | | | | | |
| 68.0 | 4.0 | — | Mn = 3 | 8 | 17 | | | | | |
| 68.0 | 4.0 | — | Mn = 3 | 8 | 17 | | | | | |
| 67.1 | 3.9 | — | Mn = 4 | 8 | 17 | | | | | |
| 69.0 | 4.0 | — | Cr = 2 | 8 | 17 | | | | | |
| 69.0 | 4.0 | — | Cr = 2 | 8 | 17 | | | | | |
| 68.0 | 4.0 | — | Mn = 2, Cr = 1 | 8 | 17 | | | | | |
| 68.0 | 4.0 | — | Mn = 2, Cr = 1 | 8 | 17 | | | | | |
| 69.0 | 4.0 | — | Nb = 2 | 8 | 17 | | | | | |
| 68.1 | 4.0 | 1.4 | Mo = 1.5 | 8 | 17 | | | | | |
| 68.1 | 4.0 | 1.4 | Mo = 1.5 | 8 | 17 | | | | | |
| 65.7 | 4.4 | 2.9 | Mo = 2 | 23 | C = 3* | | | | | |
| 65.7 | 4.4 | 2.9 | Mo = 2 | 23 | 2 | | | | | |
| 69.5 | 4.1 | 1.4 | — | 6 | 19 | | | | | |
| 68.5 | 4.4 | — | Mo = 2 | 21 | Ge = 4* | | | | | |
| 70.5 | 4.5 | — | — | 24 | Ge = 1* | | | | | |
| 69.2 | 3.8 | — | Mo = 2 | 10 | 15 | | | | | |
| 69.2 | 3.8 | — | Mo = 2 | 10 | 15 | | | | | |
| 69.0 | 3.0 | — | Mo = 3 | 10 | 15 | | | | | |
| 68.5 | 2.5 | — | Mn = 4 | 10 | 15 | | | | | |
| 68.8 | 4.2 | — | Cr = 2 | 10 | 15 | | | | | |

-continued

| | | | | |
|---|---|---|---|---|
| 420 | 15 | 70 | 2.0 | 2,400 |
| 400 | 15 | 93 | 1.7 | 2,500 |
| 420 | 15 | 73 | 0.84 | 3,600 |
| 400 | 15 | 102 | 3.2 | 13,000 |
| 420 | 15 | 82 | 0.98 | 5,000 |
| 400 | 15 | 107 | 2.0 | 29,000 |
| 420 | 15 | 87 | 3.3 | 21,500 |
| 420 | 15 | 92 | 0.70 | 15,800 |
| 420 | 15 | 83 | 0.80 | 24,000 |
| 440 | 15 | 63 | 0.84 | 21,500 |
| 420 | 15 | 91 | 1.4 | 31,500 |
| 440 | 15 | 71 | 1.1 | 24,000 |
| 440 | 15 | 101 | 3.4 | 28,700 |
| 440 | 15 | 72 | 2.9 | 35,800 |
| 460 | 15 | 52 | 3.6 | 19,300 |
| 440 | 15 | 60 | 5.6 | 2,300 |
| 450 | 15 | 62 | 10.4 | 8,000 |
| 380 | 15 | 63 | 12 | 3,300 |
| 480 | 15 | 90 | 5.2 | 17,000 |
| 420 | 15 | 74 | 6 | 600 |
| 450 | 60 | 91 | 1.5 | 21,000 |
| 460 | 60 | 81 | 1.6 | 19,300 |
| 440 | 15 | 104 | 1.2 | 17,500 |
| 440 | 15 | 108 | 1.2 | 23,000 |
| 460 | 15 | 80 | 0.8 | 20,000 |

*All of Si content is replaced by the indicated element.
**cooling rate ≃ −3° C./min.
***cooling rate ≃ −60° C./min.

This table teaches the importance of the quantity $\Delta T_{c\text{-}a}$ being between about 50 and 110° C. and relatively slow cooling rates after the heat-treatments at temperature $T_a$ and for the duration $t_a$. It is also noted that $\mu_o$ values are higher and the $H_c$ values are lower than those of prior art materials. For example, a properly heat-treated ($T_a$=460° C.; $t_a$=5 min.) $Co_{67.8}Fe_{4.2}Cr_1B_{12}Si_{15}$ glassy alloy exhibits $\mu_o$=50,000 and $H_c$=0.2 A/m whereas one of the improved prior art alloy, namely 7.5-45-25 Mo-Perminvar, gives $\mu_o$=100 and $H_c$=40 A/m when furnace cooled from 1100° C. and gives $\mu_o$=3,500 when quenched from 600° C.

In many magnetic applications, lower magnetostriction is desirable. For some applications, however, it may be desirable or acceptable to use materials with a small positive or negative magnetostriction. Such near-zero magnetostrictive glassy metal alloys are obtained for "a", "b", "c" in the ranges of about 66 to 71, 2.5 to 4.5 and 0 to 3 atom percent respectively, with the proviso that the sum of "a", "b", and "c" ranges between 72 and 76 atom percent. The absolute value of saturation magnetostriction $|\lambda_s|$ of these glassy alloys is less than about $1\times10^{-6}$ (i.e. the saturation magnetostriction ranges from about $\times1\times10^{-6}$ to $+1\times10^{-6}$ or from −1 to +1 microstrains).

The glassy alloys of the invention are conveniently prepared by techniques readily available elsewhere; see e.g. U.S. Pat. No. 3,845,805 issued Nov. 5, 1974 and No. 3,856,513 issued Dec. 24, 1974. In general, the glassy alloys, in the form of continuous ribbon, wire, etc., are rapidly quenched from a melt of the desired composition at a rate of at least about $10^5$ K/sec.

A metalloid content of boron and silicon in the range of about 25 to 27 atom percent of the total alloy composition is sufficient for glass formation with boron ranging from about 6 to 24 atom percent. It is preferred, however, that the content of metal M, i.e. the quantity "d" does not exceed very much from about 2 atom percent except when M=Mn to maintain a reasonably high Curie temperature (≧200° C.).

In addition to the highly non-linear nature of the glassy Perminvar alloys of the present invention, these alloys exhibit high permeabilities and low core loss at high frequencies. Some examples of these features are given in Table III.

TABLE III

Core loss (L) and impedance permeability ($\mu$) at f = 50 kHz and induction level of 0.1 Tesla for some of the glassy Perminvar-like alloys of the present invention. $T_a$ and $t_a$ are heat-treatment temperature and time. Cooling after the heat-treatment is about −5° C./min., unless otherwise stated.

| Compositions | | | | | | | | |
|---|---|---|---|---|---|---|---|---|
| Co | Fe | Ni | M | B | Si | $T_a$(°C.) | $t_a$(min.) | L(W/kg) | $\mu$ |
| 70.5 | 4.5 | — | — | 15 | 10 | 460 | 15 | 35 | 2,300 |
| 70.5 | 4.5 | — | — | 15 | 10 | 460 | 15** | 39 | 2,000 |
| 70.5 | 4.5 | — | — | 15 | 10 | 460 | 15*** | 14 | 3,400 |
| 69.0 | 4.1 | 1.4 | Mo = 1.5 | 12 | 12 | 430 | 120 | 14 | 2,800 |
| 65.7 | 4.4 | 2.9 | Mo = 2 | 11 | 14 | 420 | 15 | 6.7 | 6,000 |
| 68.2 | 3.8 | — | Mn = 1 | 12 | 15 | 480 | 15 | 4.6 | 14,000 |
| 68.2 | 3.8 | — | Mn = 1 | 12 | 15 | 500 | 15 | 4.4 | 9,300 |
| 67.7 | 3.3 | — | Mn = 2 | 12 | 15 | 480 | 15 | 4.0 | 17,600 |
| 67.7 | 3.3 | — | Mn = 2 | 12 | 15 | 500 | 15 | 4.5 | 17,000 |
| 67.8 | 4.2 | — | Mo = 1 | 12 | 15 | 500 | 15 | 4.0 | 27,600 |
| 67.8 | 4.2 | — | Cr = 1 | 12 | 15 | 480 | 15 | 4.0 | 24,700 |
| 67.8 | 4.2 | — | Cr = 1 | 12 | 15 | 500 | 15 | 3.7 | 22,500 |
| 69.2 | 3.8 | — | Mo = 2 | 8 | 17 | 460 | 15 | 9.0 | 5,400 |
| 69.2 | 3.8 | — | Mo = 2 | 8 | 17 | 460 | 30 | 6.3 | 14,900 |
| 69.2 | 3.8 | — | Mo = 2 | 8 | 17 | 460 | 45 | 6.6 | 13,800 |
| 69.2 | 3.8 | — | Mo = 2 | 8 | 17 | 460 | 90 | 6.7 | 14,400 |
| 69.2 | 3.8 | — | Mo = 2 | 8 | 17 | 460 | 105 | 6.9 | 14,800 |
| 67.5 | 4.5 | 3.0 | — | 8 | 17 | 380 | 45 | 19 | 3,000 |
| 67.5 | 4.5 | 3.0 | — | 8 | 17 | 380 | 60 | 20 | 2,800 |
| 67.5 | 4.5 | 3.0 | — | 8 | 17 | 380 | 90 | 21 | 2,900 |
| 67.5 | 4.5 | 3.0 | — | 8 | 17 | 380 | 105 | 18 | 2,900 |
| 67.5 | 4.5 | 3.0 | — | 8 | 17 | 420 | 15 | 22 | 3,000 |
| 70.9 | 4.1 | — | — | 8 | 17 | 400 | 15 | 31 | 2,400 |
| 70.9 | 4.1 | — | — | 8 | 17 | | | | |
| 69.9 | 4.1 | — | Mn = 1 | 8 | 17 | | | | |
| 69.9 | 4.1 | — | Mn = 1 | 8 | 17 | | | | |
| 69.0 | 4.0 | — | Mn = 2 | 8 | 17 | | | | |
| 69.0 | 4.0 | — | Mn = 2 | 8 | 17 | | | | |
| 68.0 | 4.0 | — | Mn = 3 | 8 | 17 | | | | |
| 68.0 | 4.0 | — | Mn = 3 | 8 | 17 | | | | |
| 67.1 | 3.9 | — | Mn = 4 | 8 | 17 | | | | |
| 69.0 | 4.0 | — | Cr = 2 | 8 | 17 | | | | |
| 69.0 | 4.0 | — | Cr = 2 | 8 | 17 | | | | |
| 68.0 | 4.0 | — | Mn = 2, Cr = 1 | 8 | 17 | | | | |
| 68.0 | 4.0 | — | Mn = 2, Cr = 1 | 8 | 17 | | | | |
| 69.0 | 4.0 | — | Nb = 2 | 8 | 17 | | | | |
| 68.1 | 4.0 | 1.4 | Mo = 1.5 | 8 | 17 | | | | |
| 68.1 | 4.0 | 1.4 | Mo = 1.5 | 8 | 17 | | | | |
| 65.7 | 4.4 | 2.9 | Mo = 2 | 23 | C = 3* | | | | |
| 65.7 | 4.4 | 2.9 | Mo = 2 | 23 | 2 | | | | |
| 68.6 | 4.4 | — | Mo = 2 | 21 | Ge = 4* | | | | |
| 69.2 | 3.8 | — | Mo = 2 | 10 | 15 | | | | |
| 69.0 | 3.0 | — | Mn = 3 | 10 | 15 | | | | |
| 68.5 | 2.5 | — | Mn = 4 | 10 | 15 | | | | |
| 68.8 | 4.2 | — | Cr = 2 | 10 | 15 | | | | |

TABLE III-continued

Core loss (L) and impedance permeability (μ) at f = 50 kHz and induction level of 0.1 Tesla for some of the glassy Perminvar-like alloys of the present invention. $T_a$ and $t_a$ are heat-treatment temperature and time. Cooling after the heat-treatment is about −5° C./min., unless otherwise stated.

| | | | |
|---|---|---|---|
| 420 | 15 | 15 | 2,000 |
| 400 | 15 | 23 | 2,800 |
| 420 | 15 | 16 | 2,700 |
| 400 | 15 | 11 | 3,800 |
| 420 | 15 | 11 | 3,800 |
| 400 | 15 | 8.0 | 5,500 |
| 420 | 15 | 10 | 5,200 |
| 420 | 15 | 5.7 | 9,250 |
| 420 | 15 | 5.5 | 12,500 |
| 440 | 15 | 4.7 | 13,200 |
| 420 | 15 | 4.8 | 10,000 |
| 440 | 15 | 4.7 | 10,500 |
| 440 | 15 | 4.2 | 11,200 |
| 440 | 15 | 6.6 | 8,200 |
| 460 | 15 | 7.2 | 7,100 |
| 440 | 15 | 20 | 2,000 |
| 450 | 15 | 27 | 2,800 |
| 480 | 15 | 9.7 | 5,200 |
| 450 | 60 | 9.1 | 9,600 |
| 460 | 60 | 10 | 7,700 |
| 440 | 15 | 8.3 | 6,500 |
| 440 | 15 | 8.3 | 8,200 |
| 460 | 15 | 5.7 | 10,300 |

*All of Si content is replaced by the indicated element.
**Cooling rate ≈ −3° C./min.
***Cooling rate ≈ −60° C./min.

EXAMPLES

1.Sample Preparation

The glassy alloys listed in Tables I–III were rapidly quenched (about $10^6$ K/sec) from the melt following the techniques taught by Chen and Polk in U.S. Pat. 3,856,513. The resulting ribbons, typically 25 to 30 μm thick and 0.5 to 2.5 cm wide, were determined to be free of significant crystallinity by X-ray diffractometry (using CuK radiation) and scanning calorimetry. Ribbons of the glassy metal alloys were strong, shiny, hard and ductile.

2. Magnetic Measurements

Continuous ribbons of the glassy metal alloys prepared in accordance with the procedure described in Example I were wound onto bobbins (3.8 cm O.D.) to form closed-magnetic-path toroidal samples. Each sample contained from 1 to 3 g of ribbon Insulated primary and secondary windings (numbering at least 10 each) were applied to the toroids. These samples were used to obtain hysteresis loops (coercivity and remanence) and initial permeability with a commercial curve tracer and core loss (IEEE Standard 106-1972)

The saturation magnetization, $M_s$, of each sample, was measured with a commercial vibrating sample magnetometer (Princeton Applied Research). In this case, the ribbon was cut into several small squares (approximately 2 mm ×2 mm). These were randomly oriented about their normal direction, their plane being parallel to the applied field (0 to 720 kA/m. The saturation induction $B_s(=4\pi M_s D)$ was then calculated by using the measured mass density D.

The ferromagnetic Curie temperature ($\theta_f$) was measured by inductance method and also monitored by differential scanning calorimetry, which was used primarily to determine the crystallization temperatures.

Magnetostriction measurements employed metallic strain gauges (BLD Electronics), which were bonded (Eastman - 910 Cement) between two short lengths of ribbon. The ribbon axis and gauge axis were parallel. The magnetostriction determined as a function of applied field from the longitudinal strain in the parallel (Δl/l) and perpendicular (Δl/l) inplain fields, according to the formula $\lambda=2/3\ [(\Delta l/l)\ -(\Delta l/l)]$.

Having thus described the invention in rather full detail, it will be understood that this detail need not be strictly adhered to but that further changes and modifications may suggest themselves to one skilled in the art, all falling within the scope of the invention as defined by the subjoined claims.

What is claimed is:

1. A magnetic alloy that is at least 70% glassy, having the formula $Co_aFe_bNi_cM_dB_3Si_f$, where M is at least one member selected from the group consisting of Cr, Mo, Mn and Nb, "a"-"f" are in atom percent and the sum of "a"-"f" equals 100, "a" ranges from about 66 to about 71, "b" ranges from about 2.5 to about 4.5, "c" ranges from 0 to about 3, "d" ranges from 0 to about 2 except when M=Mn in which case "d" ranges from 0 to about 4, "3" ranges from about 6 to about 24 and "f" ranges from 0 to about 19, with the proviso that the sum of "a", "b" and "c" ranges from about 72 to about 76 and the sum of "e" and "f" ranges from about 25 to about 27, said alloy having a value of magnetostriction between—$1\times10^{-6}$ and $+1\times10^{-6}$, a saturation induction ranging from about 0.5 to about 1 Tesla, a Curie temperature ranging from about 200 to about 450° C. and a first crystallization temperature ranging from about 440 to about 570° C., said alloy having been heat-treated by heating the alloy to a temperature between about 50 to about 110° C. below the first crystallization temperature for a time of from about 15 to about 180 minutes, and then cooling the alloy at a rate slower than about—60° C./min. said alloy further having bulk properties comprising a relatively constant permeability at low magnetic excitation and a constricted hysteresis loop.

2. The magnetic alloy of claim 1 having the formula $Co_{70.5}Fe_{4.5}B_{15}Si_{10}$.

3. The magnetic alloy of claim 1 having the formula $Co_{69.0}Fe_{4.1}Ni_{1.4}Mo_{1.5}B_{12}Si_{12}$.

4. The magnetic alloy of claim 1 having the formula $Co_{65.7}Fe_{4.4}Ni_{2.9}Mo_2B_{11}Si_{14}$.

5. The magnetic alloy of claim 1 having the formula $Co_{68.2}Fe_{3.8}Mn_1B_{12}Si_{15}$.

6. The magnetic alloy of claim 1 having the formula $Co_{67.7}Fe_{3.3}Mn_2B_{12}Si_{15}$.

7. The magnetic alloy of claim 1 having the formula $Co_{67.8}Fe_{4.2}Mo_1B_{12}Si_{15}$.

8. The magnetic alloy of claim 1 having the formula $Co_{67.8}Fe_{4.2}Cr_1B_{12}Si_{15}$.

9. The magnetic alloy of claim 1 having the formula $Co_{69.2}Fe_{3.8}Mo_2B_8Si_{17}$.

10. The magnetic alloy of claim 1 having the formula $Co_{67.5}Fe_{4.5}Ni_{3.0}B_8Si_{17}$.

11. The magnetic alloy of claim 1 having the formula $Co_{70.9}Fe_{4.1}B_8Si_{17}$.

12. The magnetic alloy of claim 1 having the formula $Co_{69.9}Fe_{4.1}Mn_{1.0}B_8Si_{17}$.

13. The magnetic alloy of claim 1 having the formula $Co_{69.0}Fe_{4.0}Mn_2B_8Si_{17}$.

14. The magnetic alloy of claim 1 having the formula $Co_{68.0}Fe_{4.0}Mn_3B_8Si_{17}$.

15. The magnetic alloy of claim 1 having the formula $Co_{67.1}Fe_{3.9}Mn_4B_8Si_{17}$.

16. The magnetic alloy of claim 1 having the formula $Co_{69\ 0}Fe_{4.0}Cr_2B_8Si_{17}$.

17. The magnetic alloy of claim 1 having the formula $Co_{68.0}Fe_{4\ 0}Mn_2CrlB_8Si_{17}$.

18. The magnetic alloy of claim 1 having the formula $Co_{69.0}Fe_{4.0}Nb_2B_8Si_{17}$.

19. The magnetic alloy of claim 1 having the formula $Co_{67.0}Fe_{4.0}Cr_2B_{12}Si_{15}$.

20. The magnetic alloy of claim 1 having the formula $Co_{68\ 5}Fe_{2.5}Mn_4B_{10}Si_{15}$.

21. The magnetic alloy of claim 1 having the formula $Co_{65.7}Fe_{4.4}Ni_{2.9}Mo_2B_{23}C_2$.

* * * * *

UNITED STATES PATENT AND TRADEMARK OFFICE

CERTIFICATE OF CORRECTION

PATENT NO. : 4,938,267

DATED : July 3, 1990

INVENTOR(S) : Ryusuke Hasegawa

It is certified that error appears in the above-identified patent and that said Letters Patent is hereby corrected as shown below:

Column 10, line 13 --$B_3$-- should read "$B_e$".

Column 10, line 20 --"3"-- should read "e".

Signed and Sealed this

Tenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,938,267

DATED : July 3, 1990

INVENTOR(S) : Ryusuke Hasegawa

It is certified that error appears in the above-identified patent and that said Letters Patent is hereby corrected as shown below:

Column 11, line 2 --Cr1-- should read "$Cr_1$".

Signed and Sealed this

Twenty-seventh Day of April, 1993

*Attest:*

MICHAEL K. KIRK

*Attesting Officer*

*Acting Commissioner of Patents and Trademarks*